United States Patent [19]

Küpper

[11] Patent Number: 4,666,095

[45] Date of Patent: May 19, 1987

[54] APPARATUS FOR LOADING A WINDING MACHINE WITH RUN-OFF SPOOLS OR CREEL BOBBINS

[76] Inventor: Wilhelm Küpper, Am Betelsberg 10, D-5144 Wegberg, Fed. Rep. of Germany

[21] Appl. No.: 707,097

[22] Filed: Mar. 1, 1985

[30] Foreign Application Priority Data

Mar. 1, 1984 [DE] Fed. Rep. of Germany ..... 3407572

[51] Int. Cl.[4] ..... B65H 54/20; B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS 3,358,940 12/1967 Beckwith, Jr. et al. ..... 242/35.5 R
3,474,975 10/1969 Brouwer et al. ..... 242/35.5 A X
3,774,859 11/1973 Brouwer et al. ..... 242/35.5 A X
3,913,853 10/1975 Raasch ..... 242/35.5 R
4,010,907 3/1977 Nishiyama et al. ..... 242/35.5 A
4,181,228 1/1980 Hashimoto et al. ..... 242/35.5 A X
4,212,433 7/1980 Matsui et al. ..... 242/35.5 A

*Primary Examiner*—Stanley N. Gilreath

[57] ABSTRACT

A method for loading a winding machine with run-off spools required by the winding machine in an irregular sequence from a rhythmically operated loading device including a spool conveyor leading toward the winding machine, and an intermediate magazine downstream of the loading device in travel direction of the spools includes storing individual spools one after the other in given storage locations on the intermediate magazine, automatically discharging the spools from the intermediate magazine in the number requested by the winding machine, and transferring the spools to the spool conveyor at a distance from each other, and an apparatus for carrying out the method.

6 Claims, 1 Drawing Figure

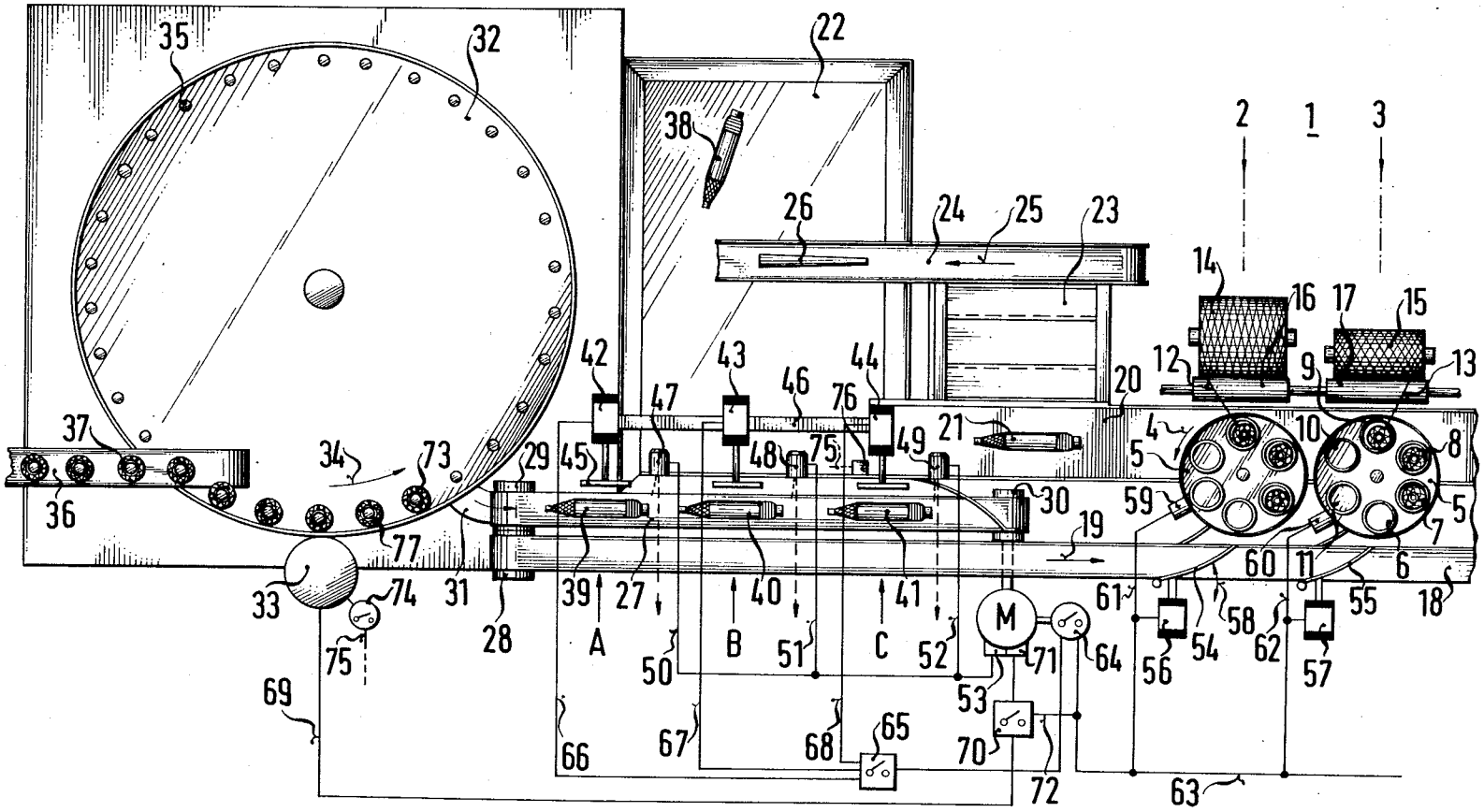
1
2
3
A
B
C
M

APPARATUS FOR LOADING A WINDING MACHINE WITH RUN-OFF SPOOLS OR CREEL BOBBINS

The invention relates to a method and apparatus for loading a winding machine with run-off spools or creel bobbins which it requires in an irregular sequence from a rhythmically operated loading device, including a spool conveyor leading to the winding machine.

During the automatic loading of a winding machine which requires run-off spools in an irregular sequence, difficulties are frequently encountered because several spool requisition commands may occur in rapid succession or simultaneously, which cannot be fulfilled with the desired speed by a uniform cycle-controlled loading device.

It is accordingly an object of the invention to provide a method and apparatus for loading a winding machine with run-off spools or creel bobbins, which overcomes the hereinafore-mentioned disadvantages of the heretofore-known methods and devices of this general type, and to ensure that the spool requirements of the winding machine are fulfilled as rapidly as possible and without delays.

With the foregoing and other objects in view there is provided, in accordance with the invention, a method for loading a winding machine with run-off spools required by the winding machine in an irregular sequence from a rhythmically operated or fixed cycle-controlled loading device, including a spool conveyor leading toward the winding machine, and an intermediate magazine downstream of the loading device in travel direction of the spools, which comprises storing individual spools one after the other in given storage locations on the intermediate magazine, automatically discharging the spools from the intermediate magazine in the number requested by the winding machine, and transferring the spools to the spool conveyor at a distance from each other.

The number of storage locations can be chosen to be great enough so that upon the occurrence of the maximum expected number of simultaneous or closely successive spool requisition signals without delay, the corresponding number of run-off spools can be discharged onto the spool conveyor without any waiting time. For instance, the spool conveyor can be constructed as a continuously running transport belt from which the required run-off spools can be guided by controllable deflectors to the respective winding station.

In accordance with another mode of the invention, there is provided a method which comprises prpgressively filling the storage locations with individual spools from the loading device beginning with the storage location furthest upstream, and progressively emptying spools from the storage locations in the number required by the winding machine beginning with the spool in the storage location furthest downstream, as seen in the travel direction of the spools. In this way, the refilling of the intermediate magazine can take place without difficulties and delays.

The use of the above-described method of loading ensures that no storage locations in the intermediate magazine remain unoccupied, and that the loading and emptying of the storage locations is performed in good order.

In accordance with a further mode of the invention, there is provided a method which comprises transporting the individual spools in the intermediate magazine from storage location to storage location. Consequently, the last storage location is always filled and the others are filled by the continues transport of the individual spools.

In order to carry out the method, there is provided an apparatus for loading a winding machine with run-off spools required by the winding machine in an irregular sequence from a rhythmically operated or fixed cycle-controlled loading device, comprising a spool conveyor leading toward the winding machine, an intermediate magazine in the form of a flat conveyor disposed downstream of the loading device in travel direction of the spools, the flat conveyor having storage locations for individual spools, means controlled by the loading device for driving the flat conveyor, means controlled by the winding machine for unloading spools from the storage locations to the spool conveyor, and means for indicating the filling state of the storage locations.

In accordance with an added feature of the invention, the unloading means are spool transfer devices with control means disposed alongside the flat conveyor at the storage locations. If the intermediate magazine is located alongside or above the spool conveyor leading to the winding machine, the unloading devices can be constructed as spool ejection devices which are activated electro-magnetically, for example, or by some other means.

In accordance with an additional feature of the invention, there are provided operative connections connected between the winding machine and the unloading means, the operative connections being activatable for transferring the number of spools required by the winding machine. This is done in order to assure that the number of spools taken from the intermediate magazine is always the same as the number requested by the winding machine.

In accordance with yet another feature of the invention, there is provided a priority circuit connected to the operative connections for activating the operative connections and discharging the spools furthest downstream in the intermediate magazine first. An orderly time sequence of the spool transfer is therefore also obtained.

In accordance with yet a further feature of the invention, there are provided means for turning on the drive means after a spool has been discharged from the loading device and for turning off the drive means when the indicating means indicates that a storage location has just been filled. At the moment that a filling state indicator recognizes that its storage location is filled, it causes the drive of the flat conveyor to stop. This also makes it possible to transport the spools from storage location to storage location during the filling of the intermediate magazine. When all of the storage locations are filled, the cut-off signal remains as a holding signal. Therefore, an over-filling of the intermediate magazine cannot occur.

In accordance with a concomitant feature of the invention, there is provided at least one blocking device connected to the drive means and the unloading means for blocking emptying of the intermediate magazine during loading of the intermediate magazine from the loading device, and for blocking loading of the intermediate magazine during emptying of the intermediate magazine onto the spool conveyor. This is done in order to ensure that the discharge operation is not inhibited by a filling operation, and vice versa.

Other features which are considered as characteristic for the invention are set forth in the appended claims.

Although the invention is illustrated and described herein as embodied in a method and apparatus for loading a winding machine with run-off spools or creel bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing which is a fragmentary, diagrammatic, top-plan view of the apparatus according to the invention.

Referring now to the figure of the drawing in detail, there are seen two winding stations 2, 3 of a winding machine, which is designated with reference numeral 1 as a whole. Each winding station has a rotatable circular magazine 5, which is provided with bobbin receptacles 6 to 11 and which rotates in the direction of an arrow 4. The bobbin receptacles 7, 8 and 9 each contain a run-off spool or creel bobbin. Threads 12, 13 which are pulled from the spools in the bobbin receptacles 9 are rewound to form cross-wound spools or cheeses 14, 15, respectively. These cheeses are driven at their outer circumference by drive rollers 16, 17, respectively.

A bobbin conveyor 18 in the form of an endless belt is disposed along the front of the circular magazine 5 of the winding machine 1. The upper half of the belt of the bobbin conveyor 18 moves in the direction of an arrow 19, i.e. toward the winding machine 1.

A tube sleeve transport band 20 is provided along the length of the machine below the circular magazines 5, which transports away the tube sleeves and spools 21 which were ejected from the winding machine 1. The ejected spools are transported to a collecting container 22 from which they can be removed from time to time. Tube sleeves 26 are transported by an elevator 23 to a transport belt 24 which is positioned higher and the tube sleeves are moved further along in the direction of an arrow 25.

An intermediate magazine 27 is provided at the left end of the winding machine 1, adjacent the bobbin conveyor 18. The intermediate magazine is constructed in the form of a flat conveyor and more particularly in the form of an endless transport band.

Although the transport belt 18 moves on a belt roller 28 at the left end thereof, the flat conveyor 27 is provided with its own belt roller 29 and furthermore has its own drive roller 30, which can be driven by a driver in the form of a motor M.

The intermediate magazine 27 can be loaded from a loading device 32 by means of a chute 31. The loading device is formed of a circular magazine which is moved forward by a stepping device 33 in a fixed rhythm in the direction of a curved arrow 34, one step at a time. The length of each step is determined by the spacing of mounting pins 35 that are disposed on an imaginary circle. The mounting pins of the loading device 32 can be loaded with run-off spools 37 which are ready to be rewound, either automatically over a conveyor band 36 or manually. The manual loading is always used when the collecting container 22 has collected ejected spools 38, which can be used again after the thread end in the interior of the tube sleeve has been located and prepared.

For reasons of simplicity, the intermediate magazine 27 shows only three storage locations A, B and C. An individual spool 39, 40 and 41, respectively, is positioned in each of these storage locations. An unloading device is provided adjacent each storage location. An unloading device 42 is near the storage location A, an unloading device 43 is near the storage location B, and an unloading device 44 is near the storage location C. All three unloading devices are constructed in such a way that they are controlled by command. In particular, each unloading device includes a spool ejector plate 45 and an electro-magnetic drive. These electro-magnetic drives are fastened to a traverse member 46. Each of the three storage locations is provided with a filling-state indicator 47, 48, 49, respectively. The filling state indicators in this case are light reflection gates. Functional or operative connections 50, 51, 52 in the form of electric lines, lead to a disconnection device 53 of the drive motor M.

A controllable diverter guide or deflector is provided adjacent each round magazine 5 of the winding machine 1. The winding station 2 is provided with a deflector 54 and the winding station 3 has a deflector 55. The deflector 54 is switched by an electro-magnetic actuator 56 and the deflector 55 is switched by an electro-magnetic actuator 57. The deflectors are illustrated in the activated state, and can move in the direction of the curved arrow 58. The winding station 2 is provided with a spool requisitioning device 59 and the winding station 3 has a spool requisitioning device 60. Functional or operative connections 61, 62 are provided from the spool requisitioning devices 59, 60 to the electro-magnetic actuators 56, 57 of the deflectors 54, 55 and to an impulse-controlled multi-position switch 65 through a collection line 63 which is conducted through a blocking switch 64. From the output of the multi-position switch 65, functional or operative connections 66, 67, 68 lead to the unloading devices 42, 43, 44. Electrical lines are chosen for these functional or operative connections. The blocking switch 64 is connected to the drive motor M and responds to its motion. As long as the drive motor M is moving, the blocking switch 64 is open.

A functional connection 69 leads from the stepping device 33 of the loading device 32 through an additional blocking switch 70 to a connection switch 71 of the motor M. The blocking switch 70 is controlled by pulses and is connected to the collecting line 63 by an impulse conductor or line 72. Whenever the blocking switch 70 receives a pulse from the collecting line 63, the switch opens, and thereby prevents the starting of the motor M for a short time.

The drawing shows that the respective receptacle 6 is unoccupied in both circular magazines. Accordingly, a pulse is sent from both spool requisitioning devices 59 and 60, which moves the two deflectors into the inserting position. The deflectors remain in the insertion position with a time delay for a time interval which is sufficient to supply a new run-off spool and to conduct it into the empty receptacle 6. The deflectors subsequently automatically return to the other position.

Since the storage locations A, B, C are filled, the disconnection device 53 remains in the turned off position and the connection device 71 is also deactivated when a turn-on pulse travels through the connection 69, because the stepping device 33 is stepping the loading device 32 one step forward to deliver a spool 73. However, the forward stepping of the loading device 32 is prevented by a blocking switch 74 which is connected to the stepping device 33. The blocking switch 74 is connected through a functional or operative connection 75 to a light gate 76, which continuously monitors whether or not a spool is positioned at the storage location C. The blocking of the stepping device 33 is effective as long as the light detector 76 reports the presence of a spool 41 at the storage location C, to the blocking switch 74.

The requisitioning pulses from the two spool requisitioning devices 59 and 60 reach the input of the impulse controlled multi-position switch 65 through the closed blocking switch 64, which subsequently activates the connections 68, 67 sequentially in time, so that the individual spool 41 is first ejected from the storage location onto the transport belt 18 by the unloading device 44, and then the spool 40 is ejected onto the belt by the unloading device 43. During this operation, the drive motor M is deactivated by the blocking switch 70.

The spool 41, which was thrown off or ejected first, is guided by the deflector 54 into the empty receptacle 6 of the winding station 2. Thereafter, the deflector 54 opens, which can be effected by a switch that senses the presence of a spool in the receptacle 6. The following spool 40 is guided into the receptacle 6 of the winding station 3 by the deflector 55. Thereafter, this deflector 55 also opens.

After the spools 41 and 40 have been ejected, the light gate 76 deactivates the blocking switch 74, so that the stepping device 33 can step ahead two steps, in order to sequentially deliver spools 73 and 77 to the intermediate magazine 27. For each switching step, a turn-on command goes to the connection switch 71 through the connection 69 and the unblocked blocking switch 70. The turn-on command remains effective until one of the filling state indicators 47 to 49, in this case the filling state indicator 48, reports that a spool has arrived at the storage location B. This pulse acts on the disconnection device 53 through the connection 51, which then turns off the motor M. Due to the next switching step of the loading device 32 caused by the stepping device 32, the intermediate magazine 27 is switched forward until the filling state shown in the drawing has been reached. In the meantime, spools can be taken out at any time if requested by the spool requisitioning command. The duration of the switching steps of the loading device 32 is adjusted in such a way that the spool refilling cannot be interrupted if the winding machine 1 requisitions more spools than the loading device 32 can supply.

The invention is not limited to the illustrated and described specific embodiment which was used as an example.

I claim:

1. Apparatus for loading a winding machine with run-off spools required by the winding machine in an irregular sequence from a rhythmically operated loading device, comprising a spool conveyor leading toward the winding machine, an intermediate magazine in the form of a flat conveyor disposed downstream of the loading device in travel direction of the spools, said flat conveyor having storage locations for individual spools, means controlled by the loading device for driving said flat conveyor, means controlled by the winding machine for unloading spools from said storage locations to said spool conveyor, and means for indicating the filling state of said storage locations.

2. Apparatus according to claim 1, wherein said unloading means are spool transfer devices with control means disposed alongside said flat conveyor at said storage locations.

3. Apparatus according to claim 2, including operative connections connected between the winding machine and said unloading means, said operative connections being activatable for transferring the number of spools required by the winding machine.

4. Apparatus according to claim 3, including a priority circuit connected to said operative connections for activating said operative connections and discharging the spool furthest downstream in said intermediate magazine first.

5. Apparatus according to claim 1, including means for turning on said drive means after a spool has been discharged from the loading device and for turning off said drive means when said indicating means indicate that a storage location has been filled.

6. Apparatus according to claim 1, including at least one blocking device connected to said drive means and said unloading means for blocking emptying of said intermediate magazine during loading of said intermediate magazine from the loading device, and for blocking loading of said intermediate magazine during emptying of said intermediate magazine onto said spool conveyor.

* * * * *